US005465505A

United States Patent [19]

Kerttula

[11] Patent Number: 5,465,505

[45] Date of Patent: Nov. 14, 1995

[54] INVERTED DRYER GROUP IN A MULTI-CYLINDER DRYER IN A PAPER MACHINE

[75] Inventor: Reima Kerttula, Muurame, Finland

[73] Assignee: Valmet Paper Machinery, Inc., Helsinki, Finland

[21] Appl. No.: 172,590

[22] Filed: Dec. 23, 1993

[30] Foreign Application Priority Data

Dec. 30, 1992 [FI] Finland ..... 925942

[51] Int. Cl.[6] ..... F26B 3/00

[52] U.S. Cl. ..... 34/452; 34/117; 34/120

[58] Field of Search ..... 34/114–120, 122, 34/123; 162/206, 207; 34/443, 444, 452

[56] References Cited

U.S. PATENT DOCUMENTS

| | | | |
|---|---|---|---|
| 3,250,019 | 5/1966 | Beachler | 34/117 |
| 3,751,822 | 8/1973 | Crist | 34/116 |
| 4,000,035 | 12/1976 | Schiel et al. | 162/290 |
| 4,172,007 | 10/1979 | Kankaanpaa | 162/206 |
| 4,183,148 | 1/1980 | Koski et al. | 34/23 |
| 4,202,113 | 5/1980 | Kankaanpaa | 34/23 |
| 4,481,723 | 11/1984 | Vedenpaa | 34/114 |
| 4,680,873 | 7/1987 | Fellers | 34/116 |

FOREIGN PATENT DOCUMENTS

| | | |
|---|---|---|
| 72162 | 1/1984 | Finland . |
| 2323574 | 11/1974 | Germany . |
| 8806205 | 8/1988 | WIPO . |
| 8806204 | 8/1988 | WIPO . |

*Primary Examiner*—Denise L. Gromada
*Attorney, Agent, or Firm*—Steinberg, Rasin & Davidson

[57] ABSTRACT

An inverted dryer group having a single-wire draw in a multi-cylinder dryer in a paper machine, including steam-heated drying cylinders arranged in a lower row and against which the drying wire of the cylinder group presses a web to be dried into direct contact. Reversing cylinders or rolls of the dryer group are arranged above gaps between the drying cylinders inside a loop of the drying wire. A support wire is placed in contact with the reversing cylinders or rolls over a turning sector of about 60° to about 120°. The support wire is guided by guide rolls arranged in gaps between the reversing cylinders as well as by other necessary rolls. The web is pressed against the drying wire on the turning sector by tension of the support wire.

23 Claims, 2 Drawing Sheets

INVERTED DRYER GROUP IN A MULTI-CYLINDER DRYER IN A PAPER MACHINE

BACKGROUND OF THE INVENTION

The present invention relates to a so-called inverted dryer group provided with a single-wire draw in a multi-cylinder dryer in a paper machine, which dryer group comprises steam-heated drying cylinders arranged in a lower row. A drying wire of the cylinder group presses the web to be dried against, and into direct contact with, the steam-heated drying cylinders. In the dryer group, reversing cylinders or rolls of the dryer group are placed above gaps formed between the drying cylinders. The reversing cylinders or rolls are arranged inside a loop of the drying wire. The web to be dried is placed at the side of the outside curve on turning sectors of the reversing cylinders or rolls. A support wire is arranged to reach contact with the reversing cylinders or rolls over a substantially large sector. The support wire is guided by guide rolls placed in the gaps between the reversing cylinders as well as by other necessary rolls. The web is pressed against the drying wire on the turning sectors by means of the tension of the support wire. The present invention also relates to a method to prevent shrinkage of a paper web by utilizing the inverted dryer group in a dryer section of a paper machine.

In the prior art, in multi-cylinder dryers in paper machines, twin-wire draw and/or single-wire draw is/are employed. In the case of a twin-wire draw, the groups of drying cylinders include two wires which press the web against heated cylinder faces, i.e., one wire from above and the other one from below. Between the rows of cylinders, which are usually horizontal rows, the web has free and unsupported draws. The free draws are susceptible of fluttering which may result in web breaks. For this reason, in recent years, increasing use has been made of the single-wire draw in which there is just one drying wire in each group of drying cylinders. The web runs on support of the single drying wire through the entire dryer group so that the drying wire presses the web against the heated cylinder faces of the drying cylinders and the web remains at the side of the outside curve on the reversing cylinders placed between the drying cylinders. Thus, in a single-wire draw, the drying cylinders are placed outside the wire loop, and the reversing cylinders are arranged inside the loop of the drying wire.

In prior art normal dryer groups having a single-wire draw, the heated drying cylinders are placed in an upper row, and the reversing cylinders are placed in a lower row. The upper and lower rows are usually arranged to be horizontal and parallel to one another. In the assignee's Finnish Patent No. 54,627 (corresponding to U.S. Pat. No. 4,202,113, the specification of which is hereby incorporated by reference herein), an arrangement is described in which normal single-wire groups, mentioned above, and so-called inverted single-wire groups are arranged one after the other. In the inverted groups, the heated drying cylinders are arranged in the lower row and the reversing suction cylinders or rolls are arranged in the upper row in order to achieve the principal object, i.e., drying the web symmetrically from both of its sides.

In the prior art, reference is also made to International Patent Applications No. WO 88/06204 and WO 88/06205 of Messrs. Beloit Corp. which describe a dryer section consisting of normal and inverted cylinder groups.

In the following description, the terms "normal (dryer) group" and "inverted (dryer) group" are used and intended to designate cylinder groups having a single-wire draw similar to those described above.

Further, with respect to the prior art related to the present invention, reference is made to the assignee's Finnish Patent No. 62,693 (corresponding to U.S. Pat. No. 4,481,723, the specification of which is hereby incorporated by reference herein), which describes an arrangement wherein a lower support fabric is used in a normal group having a single-wire draw, together with pressurization of the pockets defined by them.

In prior art inverted dryer groups, cylinders or rolls which have perforated mantles with a grooved outside face and whose interior communicates with a source of negative pressure are used as reversing cylinders. By the effect of this negative pressure, the web placed on the drying wire at the side of the outside curve is held in position, and it is ensured that the web does not stretch or even become completely separated from the outside face of the drying wire in the curves. The suction cylinders are quite expensive components, and they require suction energy, ever more suction energy being consumed when the speed of the paper machine becomes higher.

OBJECTS AND SUMMARY OF THE INVENTION

It is an object of the present invention to avoid the drawbacks mentioned above and to provide a new and improved inverted dryer group with a single-wire draw in which it is ensured more efficiently that the web does not separate from the drying wire on the reversing cylinders.

It is a further object of the present invention to provide an inverted dryer group in which it is not necessary to use suction cylinders, but it is possible to apply either solid-mantle grooved reversing cylinders or rolls or even smooth-faced reversing cylinders or rolls. Attempts are made to achieve this specific and important object in particular when the machine speeds are quite low.

It is a further object of the present invention to provide an inverted dryer group in which the tail threading can be facilitated and in which, if necessary, it is possible to operate the tail threading without a rope threading system.

It is a further object of the present invention to achieve the objects stated above so that they, in themselves, do not increase the problems of removal of paper broke.

It is yet another object of the present invention to reduce the transverse shrinkage of the paper web running through a dryer section in a paper machine and the problems arising from same.

It is still another object of the present invention to provide a new and improved method to prevent shrinkage of the paper web running through an inverted dryer group in a dryer section of a paper machine.

In view of achieving the objects stated above, and others, in the present invention, in the area of a loop of a support-wire, reversing cylinders are utilized which are solid-mantle reversing cylinders provided with a grooved or smooth outer face and with no heating or suction arrangement.

By means of the present invention, three goals of different natures are achieved at the same time: (1) good runnability of the inverted group is also guaranteed when no negative pressure is employed in the upper reversing cylinders or rolls; (2) tail threading is ensured without a system of threading ropes and without application of negative pressure to the upper reversing rolls; and (3) the transverse shrinkage of the web is reduced. The last goal is achieved such that the web can be pressed tightly against the drying wire by means of the support wire so that the web hardly shrinks.

In the method of the present invention, which prevents shrinkage of a paper web in an inverted dryer group having a single-wire draw, steam-heated drying cylinders are arranged in a lower row. A web to be dried is pressed while running on a drying wire against the drying cylinders. Reversing cylinders or rolls are arranged above gaps between the drying cylinders and inside a loop of the drying wire such that the web runs on an outside curve of turning sectors of the reversing cylinders or rolls. A support wire presses the web against the drying wire over a substantially large sector of at least one of the reversing cylinders or rolls. Preferably, the at least one reversing cylinders or rolls, over which the support wire presses the web against the drying wire, is a solid-mantle reversing cylinder having a grooved or smooth outer face. In a preferred embodiment, guide rolls may be arranged in gaps between the reversing cylinders to guide the support wire. The support wire is driven in a loop such that the angular speed of the support wire in relation to a center point of the at least one reversing cylinders, over which the support wire presses the web, is equal to the corresponding angular speed of the web and the drying wire. The support wire may be arranged to press the web against all, or only part, of the reversing cylinders or rolls in the dryer group.

In the following, the invention will be described in detail with reference to some exemplifying embodiments of the invention illustrated in the figures in the accompanying drawings. However, the present invention is by no means strictly confined to the details of these embodiments.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
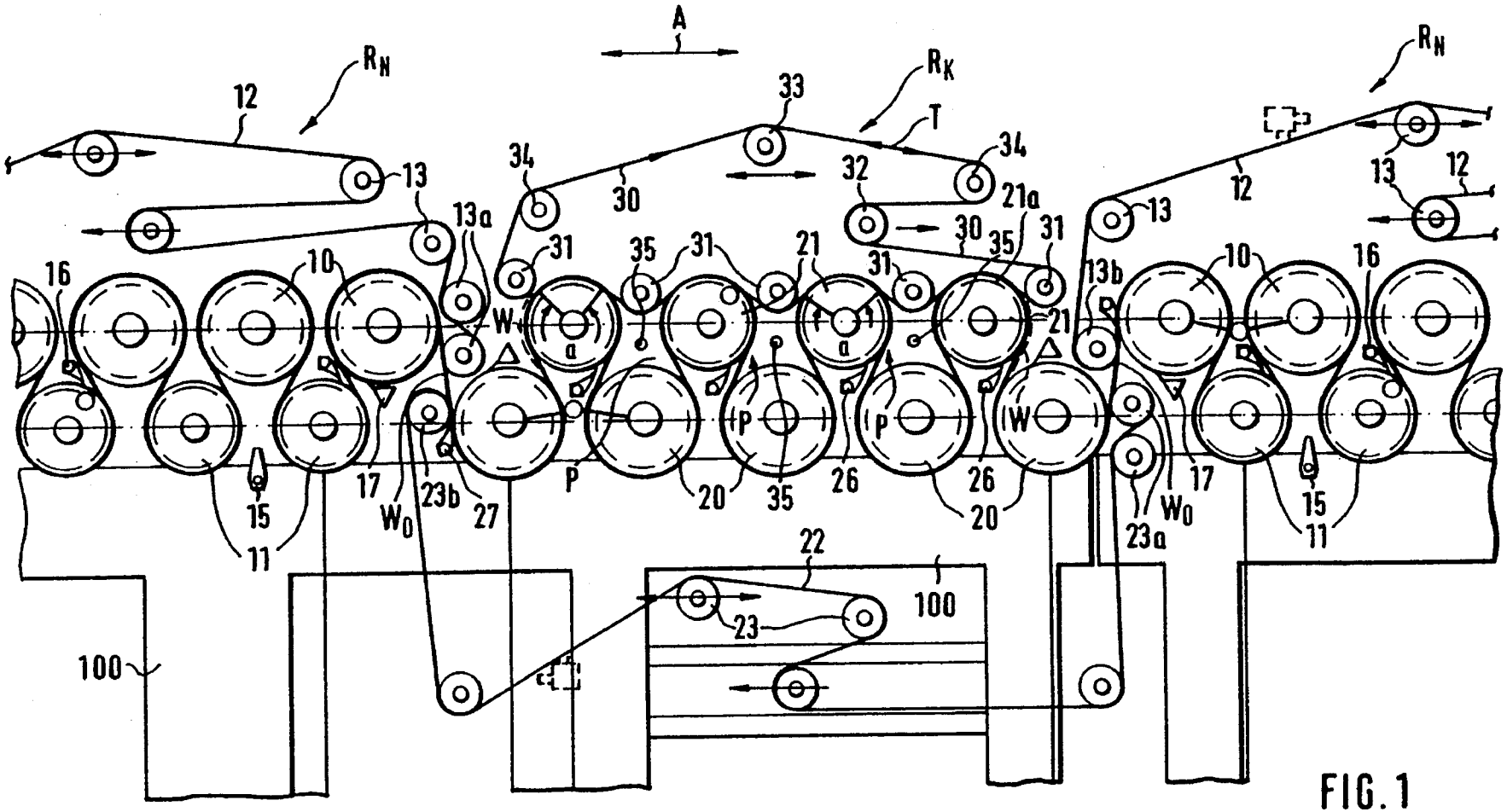
FIG. 1 shows a paper machine dryer section in which a so-called inverted dryer group in accordance with the present invention is employed.
Figure 2:
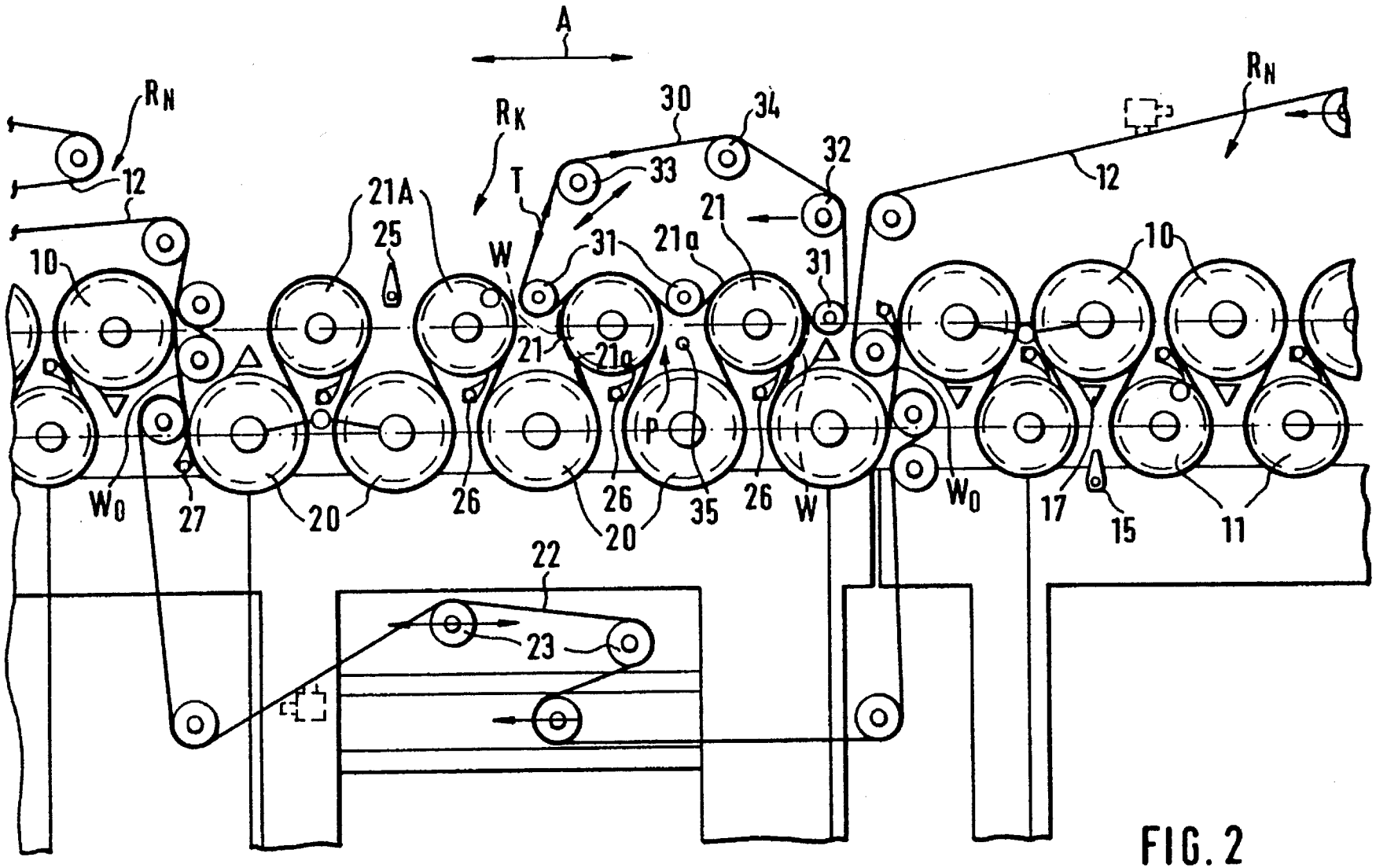
FIG. 2 shows a modified embodiment of the present invention, in a manner corresponding to FIG. 1, in which the support wire extends over a portion of the length of the inverted group only.

Referring to FIGS. 1 and 2, a dryer section is shown in which a web W to be dried progress in a direction of progress A and engages with a series of dryer groups. First, the web engages with normal dryer group $R_N$ as shown, then an inverted group $R_K$ which is followed by another normal dryer group $R_N$. At the group gaps $R_N$-$R_K$-$R_N$, the web W has primarily open draws $W_0$. However, in some cases it is also possible to use a fully or almost fully closed draw. In the normal groups $R_N$, steam-heated drying cylinders 10 are arranged in an upper horizontal row and reversing cylinders 11 are arranged in a lower horizontal row, so that a so-called single-wire draw is carried out. In the inverted group $R_K$, steam-heated drying cylinders 20 are arranged in a lower row and reversing cylinders 21 are arranged in an upper row. Wires 12 in the normal groups $R_N$ are guided by a plurality of guide rolls 13. The web W is transferred from the last one **13*b* of the guide rolls 13 as an open draw $W_O$ to the inverted group $R_K$ in the area of a guide rolls 23*a* of the inverted group $R_K$. Through the group $R_K$ the web W runs, guided by drying wire 22, as a so-called single-wire draw to the beginning of the next group $R_N$. The web is transferred from inverted group $R_K$ as a free draw $W_O$ in the area of the drying-wire 12 guide rolls 13*a*. Further, the dryer section includes air-blow means 16,26 and doctors 17**.

In the present invention, in connection with the upper reversing cylinders 21 in the inverted group $R_K$, a support-wire loop 30 is arranged, which is guided by guide rolls 31 arranged in the gaps between the reversing cylinders 21, by upper guide rolls 34, by a tensioning roll 32 and by an alignment roll 33. The support wire 30 is in contact with the reversing cylinders 21 from above over the sector a and presses the web W, by means of its tension T, against the drying wire 22 and the cylinders 21. In this manner, separation of the web W from the drying wire 22 on the cylinders 21, which tends to be promoted by the centrifugal forces at the curves as well as by the transverse shrinkage of the web W, is effectively prevented,.

As the support wire 30, preferably an open wire-like fabric is used whose permeability is selected at least equally as high as, and even preferably substantially higher than, the permeabilities of the drying wires 12,22. Typically, the permeability of the support wire 30 is greater than about 2000 m/h. An open fabric is used because a very dense fabric as a support wire 30 would reduce the evaporation from the web W and might produce faults in the transverse profile in the web W, in particular when the support wire 30 does not extend over the entire width of the web W.

The support wire 30 is preferably extended across the entire width of the web W and preferably over the entire length of the inverted group in the machine direction. However, in some particular cases it is also possible to utilize a narrower support wire which extends across the width of the leader strip of the web only or across only a portion of the width of the paper web at least in an area of the leader strip. In some entirely specific cases, it is possible to use narrow support wire loops 30 placed at both lateral areas of the web W because the web W has a particular tendency to be separated from the drying wire 22 in its lateral areas.

The support wire loop 30 is preferably provided with a drive of its own, by whose means the speed of the support wire 30 is regulated such that its angular speed on the sectors a of the reversing cylinders 21, over which the support wire presses the web against the drying wire, in relation to their center points becomes equal to the corresponding angular speed of the drying wire 22 and of the web W. As a result of this speed regulation, substantially no grinding of the web is produced, which would otherwise causes a deterioration in quality and formation of dust. The magnitude of the sector a is generally selected in a range from about 60° to about 200°, preferably in a range from about 90° to about 120°. The tightening tension T of the support wire 30 is preferably selected in a range from about 1 kN/m to about 4 kN/m, which is substantially in the same range as the tension of the drying wires 20,22.

In the present invention, solid-mantle reversing cylinders 21 are used instead of the reversing suction cylinders 21. Solid-mantle reversing cylinders do not communicate with sources of negative pressure and have grooves 21 which circulate in the outer faces of the cylinders. In low-speed machines, it is even possible to use reversing cylinders 21 provided with smooth solid mantles.

The embodiment of the present invention shown in FIG. 2 differs from that shown in FIG. 1 in the respect that the support wire 30 has been extended over a portion of the length of the inverted group $R_K$ only, more specifically over only two reversing cylinders 21. In such a case, it is possible to use, as reversing cylinders 21, solid-mantle reversing cylinders 21 provided with a grooved outer face 21*a* or, in other cases, even with a smooth face. In the area of the inverted group $R_K$ to which the support-wire loop 30 does not extend, normal suction-reversing cylinders 21A are arranged. Blow means 25 are arranged in the gap or gaps between the cylinders 21A and increase evaporation of water and/or ventilation.

Since the support wire 30 closes the pocket spaces P that remain above the drying cylinders 20, it is advisable to consider adequate ventilation of these pocket spaces P and provide, e.g., blow means necessary for this purpose as shown schematically by blow pipes 35.

With respect to the diameters of the cylinders 10,21 and 21*a* and of the guide rolls 13,13*a*,13*b*,22,23*a*,23*b*, it should be stated that, typically and preferably, the diameter of the drying cylinders 10,20 is about 1830 mm, the diameter of the reversing cylinders 11,21,21A is about 1500 mm, and the diameters of the guide rolls are in a range from about 500 mm to about 800 mm, depending on the width of the paper machine.

The examples provided above are not meant to be exclusive. Many other variations of the present invention would be obvious to those skilled in the art, and are contemplated to be within the scope of the appended claims.

I claim:

1. An inverted dryer group having a single-wire draw in a multi-cylinder dryer in a paper machine, comprising steam-heated drying cylinders arranged in a lower row, reversing cylinders arranged in an upper row above gaps between said drying cylinders, a drying wire arranged to press a web to be dried against said drying cylinders, said reversing cylinders being arranged inside a loop of said drying wire such that the web runs on an outside curve of turning sectors of said reversing cylinders, and a support wire arranged to contact at least one of said reversing cylinders over a substantially large sector thereof, said support wire being guided by guide rolls arranged in gaps between said reversing cylinders, the web being pressed by said support wire against said drying wire on the large sector of said at least one of said reversing cylinders or rolls by tension of said support wire, wherein said at least one reversing cylinder is an unheated solid-mantle reversing cylinder.

2. The dryer group of claim 1, wherein the magnitude of said turning sector of said at least one reversing cylinder is from about 60° to about 200°.

3. The dryer group of claim 1, wherein the magnitude of said turning sector of said at least one reversing cylinder is from about 90° to about 120°.

4. The dryer group of claim 1, wherein said support wire extends over only a portion of the length of the inverted group in the machine direction and does not run over all of said reversing cylinders in the inverted group.

5. The dryer group of claim 1, wherein said support wire extends over the entire length of the inverted group in the machine direction.

6. The dryer group of claim 1, wherein said support wire extends in a transverse direction across the entire width of the paper web.

7. The dryer group of claim 1, wherein said support wire extends in a transverse direction across only a portion of the width of the paper web at least in an area of a leader strip of the web.

8. The dryer group of claim 1, wherein said support wire is a permeable, relatively open wire-like fabric having a permeability greater than about 2000 m/h.

9. The dryer group of claim 1, wherein said support-wire loop is driven such that the angular speed of said support wire in relation to a center point of said at least one reversing cylinder is equal to the corresponding angular speed of the web and said drying wire.

10. The dryer group of claim 1, wherein the tension of said support wire in the machine direction is set in a range from about 1 kN/m to about 4 kN/m.

11. The dryer group of claim 1, further comprising air-blow means for ventilating pockets that are closed by said support wire running between adjacent ones of said reversing cylinders.

12. The dryer group of claim 1, wherein said at least one reversing cylinder has a grooved outer face.

13. The dryer group of claim 1, wherein said at least one reversing cylinder lacks both a heating system and a suction system.

14. The dryer group of claim 4, wherein said reversing cylinders over which said support wire does not extend comprise suction-reversing cylinders.

15. A method to prevent shrinkage of a paper web in an inverted dryer group having a single-wire draw, comprising arranging steam-heated drying cylinders in a lower row, pressing a web to be dried running on a drying wire against said drying cylinders, arranging reversing cylinders above gaps between said drying cylinders and inside a loop of said drying wire such that the web runs on an outside curve of turning sectors of said reversing cylinders or rolls, at least one of said reversing cylinders being unheated and having a solid-mantle, and guiding a support wire to press the web against said drying wire over a substantially large sector of said at least one reversing cylinder.

16. The method of claim 15, wherein said at least one reversing cylinder is a solid-mantle reversing cylinder having a grooved or smooth outer face.

17. The method of claim 15, further comprising arranging guide rolls in gaps between said reversing cylinders to guide said support wire.

18. The method of claim 15, further comprising driving said support wire in a loop such that the angular speed of said support wire in relation to a center point of said at least one reversing cylinder is equal to the corresponding angular speed of the web and said drying wire.

19. The method of claim 15, further comprising arranging said support wire to press the web against all of said reversing cylinders in said dryer group.

20. A dryer section in a paper machine, comprising an inverted dryer group comprising steam-heated drying cylinders arranged in a lower row, reversing cylinders arranged in an upper row above gaps between said drying cylinders, a drying wire arranged to press a web to be dried against said drying cylinders, said reversing cylinders being arranged inside a loop of said drying wire such that the web runs on an outside curve of turning sectors of said reversing cylinders, and a support wire arranged to contact at least one of said reversing cylinders over a substantially large sector thereof, said at least one reversing cylinder being an unheated solid-mantle reversing cylinder, and a first normal dryer group preceding said inverted dryer group and a second normal group following said inverted dryer group, said first and second normal groups comprising drying cylinders arranged in an upper row and reversing cylinders arranged in a lower row, and the web having an open draw or a closed draw between said inverted group and said first and second normal groups.

21. The dryer section of claim 20, wherein said at least one reversing cylinder has a grooved outer face.

22. The dryer section of claim 20, wherein said reversing cylinders in said lower row of said normal group are selected from the group consisting of unheated reversing rolls and suction rolls having an internal suction box.

23. The dryer section of claim 20, wherein said inverted group and said first and second normal drying groups have a single-wire draw.

* * * * *